US008235080B2

(12) United States Patent
Lee

(10) Patent No.: US 8,235,080 B2
(45) Date of Patent: Aug. 7, 2012

(54) INTERLOCKING, ADJUSTABLE EDGE-FORMING ROUTER BIT

(75) Inventor: Robin C. Lee, Ottawa (CA)

(73) Assignee: Lee Valley Tools, Ltd., Ottawa, Ontario (CA)

( * ) Notice: Subject to any disclaimer, the term of this patent is extended or adjusted under 35 U.S.C. 154(b) by 223 days.

(21) Appl. No.: 12/616,975

(22) Filed: Nov. 12, 2009

(65) Prior Publication Data

US 2010/0122752 A1 May 20, 2010

Related U.S. Application Data

(60) Provisional application No. 61/199,448, filed on Nov. 17, 2008.

(51) Int. Cl.
*B27C 1/00* (2006.01)
*B27G 13/00* (2006.01)

(52) U.S. Cl. ..... 144/237; 144/240; 144/241

(58) Field of Classification Search ..... 144/237, 144/240, 241; 407/55, 59, 61; 408/227, 408/226, 231, 713; 409/31, 38, 40, 50, 55, 409/138, 192, 203, 217
See application file for complete search history.

(56) References Cited

U.S. PATENT DOCUMENTS

| | | | | |
|---|---|---|---|---|
| 1,933,232 | A | 10/1933 | Vaughan | |
| 4,505,086 | A | 3/1985 | Hansen | |
| 4,674,923 | A * | 6/1987 | Ogilvie et al. | 407/31 |
| 4,728,231 | A * | 3/1988 | Kunimori et al. | 408/59 |
| 5,289,861 | A | 3/1994 | Hedrick | |
| 5,468,100 | A * | 11/1995 | Naim | 409/234 |
| 5,615,718 | A * | 4/1997 | Venditto | 144/135.2 |
| 5,662,436 | A * | 9/1997 | Bishop | 407/35 |
| 5,899,252 | A | 5/1999 | Pozzo | |
| 5,996,659 | A | 12/1999 | Burgess | |
| 6,120,218 | A * | 9/2000 | Bishop | 407/34 |
| 6,354,347 | B1 | 3/2002 | Brewer | |
| 6,367,524 | B1 | 4/2002 | Brewer | |
| 6,736,173 | B1 | 5/2004 | Grisley et al. | |
| 6,986,627 | B2 * | 1/2006 | Feld | 408/144 |
| 7,131,473 | B1 * | 11/2006 | Brewer | 144/371 |
| 7,150,589 | B2 * | 12/2006 | Nordlin | 409/138 |
| 7,591,617 | B2 * | 9/2009 | Borschert et al. | 408/226 |
| 2006/0086424 | A1 * | 4/2006 | Spector et al. | 144/237 |

OTHER PUBLICATIONS

Hyde, Brent K. U.S. Appl. No. 10/824,104 entitled "Box Slotting Router Bit," filed Apr. 14, 2004.

Lee Valley Tools, Ltd., "Chair Rail Bits," http://www.leevalley.com/wood/page.aspx?c=2&cat=1,46168,46177,30108&p=30108, Admitted Prior Art, known prior to Nov. 12, 2009.

Lee Valley Tools, Ltd., "Finger-Joint Router Bit," http://www.leevalley.com/wood/page.aspx?c=2&cat=1,46168,46174,30210&p=30210, Admitted Prior Art, known prior to Nov. 12, 2009.

(Continued)

*Primary Examiner* — Bena Miller
(74) *Attorney, Agent, or Firm* — Kilpatrick Townsend & Stockton LLP; John S. Pratt; Camilla C. Williams

(57) ABSTRACT

An adjustable router or shaper cutter assembly that facilitates the formation of an edge contour such as a rounded over contour on work-pieces of differing thicknesses.

3 Claims, 2 Drawing Sheets

OTHER PUBLICATIONS

Lee Valley Tools, Ltd., "Four-in-One Grooving Bit," http://www.leevalley.com/wood/page.aspx?c=2&cat=1,46168,46174,30222&p=30222, Admitted Prior Art, known prior to Nov. 12, 2009.

Lee Valley Tools, Ltd., "Plywood Edging Bits," http://www.leevalley.com/wood/page.aspx?c=2&cat=1,46168,62157,50698&p=50698, Admitted Prior Art, known prior to Nov. 12, 2009.

Lee Valley Tools, Ltd., "Triple Flute Bits," http://www.leevalley.com/wood/page.aspx?c=2&cat=1,46168,46184,30152&p=30152, Admitted Prior Art, known to prior to Nov. 12, 2009.

http://www.leevalley.com/US/wood/page.aspx?p=53250&cat=1,46168,62157.

* cited by examiner

INTERLOCKING, ADJUSTABLE EDGE-FORMING ROUTER BIT

RELATED APPLICATION

This application claims the benefit of U.S. Provisional Patent Application No. 61/199,448 filed Nov. 17, 2008, the contents of which are incorporated herein by reference.

FIELD OF THE INVENTION

This invention relates to woodworking cutters generally, to router bits and, in particular, to edge-forming router bits.

BACKGROUND OF THE INVENTION

In woodworking, wood work-pieces not yet brought to final shape and size are often pieces of wood about three-fourths to one inch thick with front and back faces (or top and bottom faces) and with "edges" as broad as the thickness of the work-piece. The edges usually intersect the front and back faces at right angles, forming an "arris" where the plane or face of an edge and each of the front and back faces intersect.

It is often desirable to shape the edge of a wood work-piece. This is often most easily accomplished by shaping only a portion, such as one "corner" proximate one arris, of the work-piece edge at a time, requiring multiple operations to shape an entire work-piece edge. However, it is sometimes desirable simultaneously to shape the entire edge of a work-piece, that is, to shape the entire edge in one operation. Existing cutters are available for doing so, including rounding over cutters, bull nose cutters, and a variety of stacking and re-configurable cutters. Some such cutters are adjustable, but the capacity of such cutters to be adjusted is typically severely limited, usually within an adjustment range of only a few thousandths of an inch.

One of the complexities associated with edge-shaping or forming is the desirability of being able to form edge shapes on work-pieces having differing thicknesses. For instance, a huge fraction of all work-pieces used in cabinet making range in thickness between 0.75 inch and 1.0 inch, but many different thicknesses are used within that range.

As an example of an application requiring edge-shaping, it is often necessary to create a handle (or tote) for an item being made or repaired, such as a bench plane or a table saw jig to be slid on the saw table by manipulating a handle attached to the jig. The need to make a handle is particularly frequent when restoring or customizing an antique tool. Wooden handles on such tools are prone to damage and often need to be replaced. Furthermore, a user may want to replace a handle with one that better fits the user's grip.

These handles are often fairly complex, curved shapes, and getting a smooth shape can be very difficult. The typical approach is to cut the shape out using a scroll or band saw and then shape the final curves with rasps, files and sandpaper.

This exemplary need for a means for shaping edges with different thicknesses illustrates the desirability of a router cutter with such capability.

SUMMARY OF THE INVENTION

The cutter of this invention is an adjustable router bit or cutter assembly (or other rotating cutter such as a shaper cutter) that facilitates the formation of a particular edge contour on work-pieces of differing thicknesses. While other ways of guiding the cutter assembly are possible, in one embodiment, the cutter assembly uses a bearing to follow a template to establish the basic shape of the work-piece. Templates can be made of thinner, easier to shape materials that can be more accurately cut with smoother curves than a thick, typically solid wood, work-piece. This results in a final part that is closer to the desired shape than might otherwise be the case. Moreover, use of a template rather than guiding the cutter assembly by reference to a portion of the work-piece itself enables the cutter to remove all of the original work-piece edge surface, which is not possible with a cutter assembly guided by reference to (i.e., by contact with) a portion of that surface.

The profile of the embodiment of the cutter or bit of this invention illustrated in the Figures is such that it creates a full (continuous) "round-over" on the edge of the part, such that once the bit has been run around the part blank following the template (or the work-piece has been moved relative to and in contact with the bit or cutter), the finished part is both the correct over-all shape and has a desired cross-sectional shape, such as a shape usable as a handle. Further shaping may be desired by the user to refine the cross-section, however such further shaping typically only requires the removal of relatively small amounts of material from the work-piece.

The bit or cutter assembly of the embodiment depicted in the Figures is configured such that it is adjustable for work-piece thickness or width within the range of typical handle thicknesses (most are between approximately ¾ and one inch thick). The bit has two independent cutters, one preferably (but not necessarily) permanently fixed to the shaft, while the second cutter is positionable on the shaft at different locations relative to the other (typically fixed) cutter. The cutters "interlock," which is to say that they overlap and lock so that: (a) one cannot rotate relative to the other, (b) cutting "heights" of the two cutters can over-lap without the cutters (or their blades) contacting each other, and (c) the entire edge of the work-piece is contacted and shaped by the cutter assembly. The two cutters can be positioned at selected different positions to each other, by use or removal of shims or washers between the two cutters, or by any other appropriate spacing structure or means.

In one embodiment, each of the two cutters cuts approximately one quarter-round, and the two cutters together create a substantially half round shape (the shape need not actually be a constant radius, but can be a modified curve to give the best results within the range of adjustment). Other profiles could also be used.

Alternate designs for this bit may use three or more cutters to create a "stack" that makes up the desired profile, and less than all of such cutters may be usable to shape a thinner profile than is possible with all of the cutters in the stack.

The cutters may be of a two-flute design, but can also be made with one flute, or with more than two flutes as desired.

DETAILED DESCRIPTION

Figure 1:
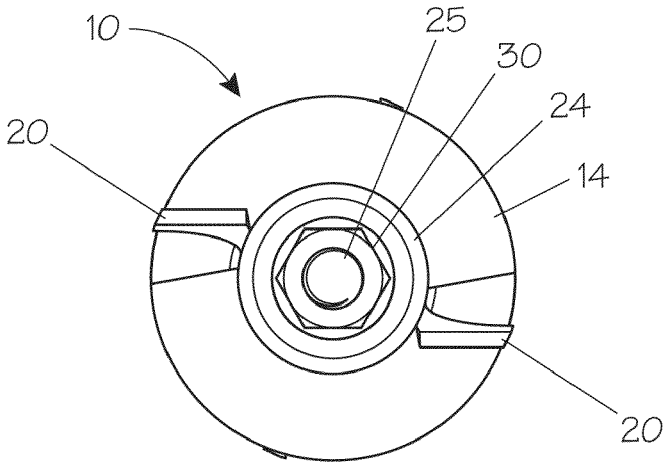
FIG. 1 is an end view of the cutter assembly of one embodiment of this invention.
Figure 2:
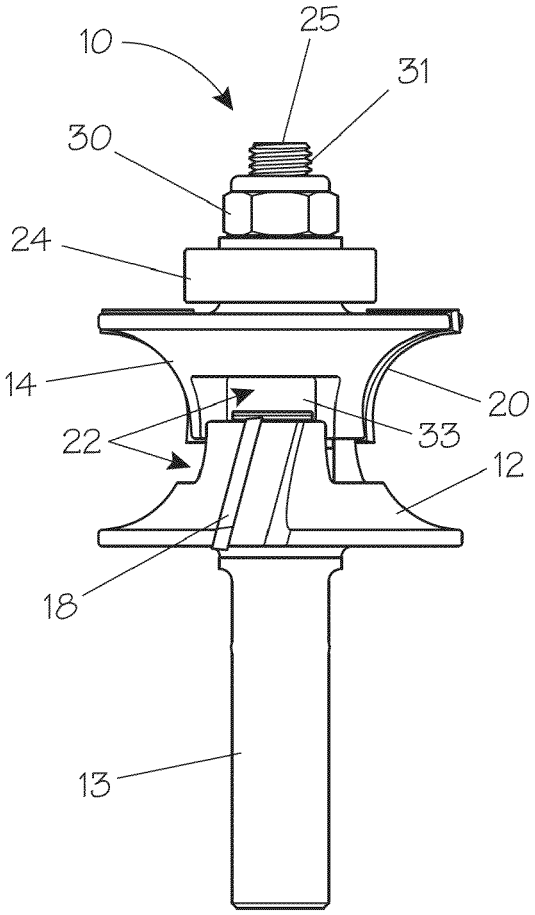
FIG. 2 is a side view of the cutter assembly shown in FIG. 1 with washers between the cutters so that they are somewhat separated.

In an embodiment of the cutter assembly 10 of this invention illustrated in the Figures, two cutters 12 and 14 on a shaft 13 may be are adjusted for cutter assembly width (or height), which is to say that their relative positions on shaft 13 may be changed, using a number of shim washers 16 between reference surfaces on the two cutters 12 and 14. For instance, shims of 0.050", 0.020" and 0.010" thicknesses may be combined in different configurations to create desired spacing. This could also be achieved with shims of uniform thickness, or with a range of specific shims for specific spacing.

In the alternative, spacing could be set using a spring (not shown) on shaft 13 between the cutters 12 and 14, and with appropriate means for locking the cutters relative to each other. For instance, one of the cutters can be locked or permanently attached to the shaft and the other can be repositionably secured with a locking nut.

The illustrated embodiment 10 of the cutter assembly depicts use of carbide inserts or attachments to the bodies 11 and 13 of cutters 12 and 14 to provide pairs of cutter blades 18 and 20. Other appropriate materials could be used as alternatives to carbide inserts. Moreover, cutters 12 and 14 could utilize solid carbide or solid steel bodies 11 and 15, appropriately shaped and sharpened to provide integral cutter blades 18 and 20.

As mentioned above, and as can be appreciated by reference to the Figures, the cutter blades 18 and 20 on the two different cutters 12 and 14 must overlap in order to cut a full profile without a gap. Modest overlapping of carbide blade inserts in, for instance, dado blade sets is not uncommon, but the amount of such overlap is typically no more than the amount of carbide insert projection beyond the tool body to which the carbide is attached, and only limited carbide projection is feasible without risk of breakage.

In order to achieve the significant overlap between the blades 18 and 20 of cutter assembly 10 necessary to accommodate changes in cutter width on the order of as much as one quarter inch or more, there must be overlap not only of the blades 18 and 20 but also of portions of the cutter bodies 11 and 15.

Figure 4:
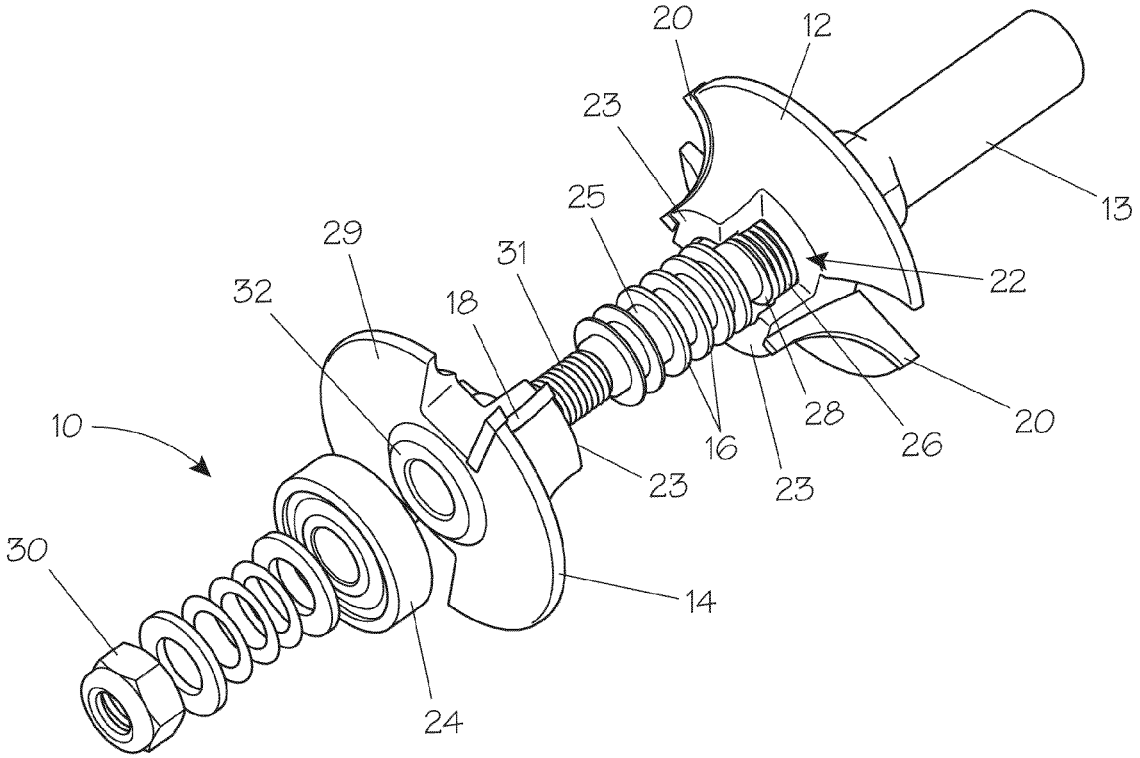
FIG. 4 is an exploded perspective view of the cutter assembly shown in FIG. 1.

This is achieved by providing each of the cutter 12 and 14 body 11 and 15 structures with recesses 22 (one of which may be best seen in FIG. 4) defined by (or between) protrusions 23. Recesses 22 in one cutter 12 or 14 receive protrusions 23 from the other cutter 14 or 12. This enables significant overlapping of the blades 20 on cutter 12 with blades 18 on cutter 14 and interlocks the two cutters 12 and 14 to prevent rotation of one cutter relative to the other.

Such locking of cutters relative to each other can be desirable even if two or more cutters are used to form a profile that doesn't require blade overlap of the sort present in the cutter assembly 10 depicted in the Figures. Where there is blade overlapping, the interlocking or inter-fitting described above and shown in the Figures insures that brittle and somewhat fragile blades 18 and 20 cannot contact and risk damage to each other. Such interlocking also assures that blades in one cutter do not align with blades in another cutter and engage the work-piece at the same time but rather engage the work-piece sequentially, thereby making cutting easier.

The geometry of the cutter bodies in the illustrated embodiment provide both inter-fitting (or overlapping) and locking of the cutters 12 and 14 to prevent rotation of one relative to the other during us. However, other structures such as a dowel pin received in holes in the cutters, or with a pin on one cutter received in a hole in the other cutter could also prevent rotation of one cutter without equal rotation of the other. Locking could also be achieved using one or more splines on the shaft interfacing with the floating cutter. Other similar devices may also be used, including, possibly keyways and a key.

Figure 3:
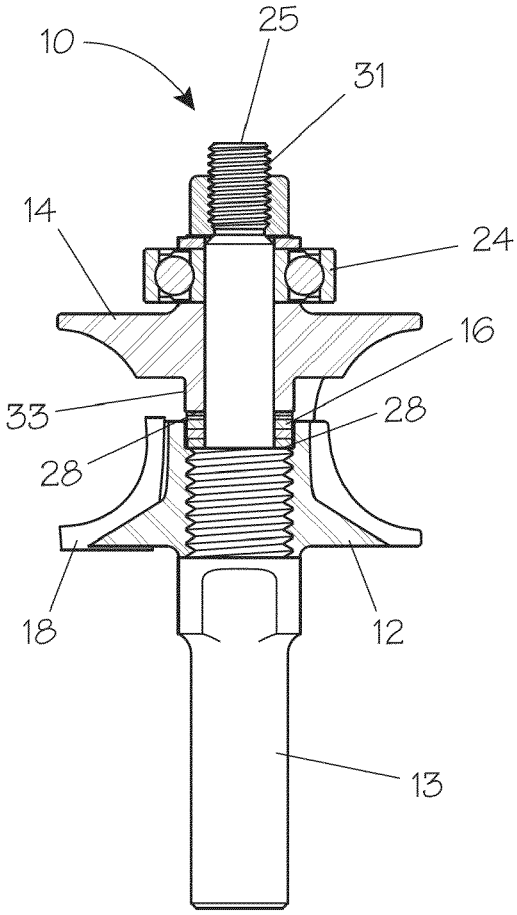
FIG. 3 is a side view of the cutter assembly shown in FIG. 1, rotated 90 degrees from the view of FIG. 2 and with the cutters, bearing, washers and nut shown in section.

Careful inspection and comparison of the Figures will reveal that protrusions 23 do not contact shaft 25 along the second half or so of their extensions. Instead, the protrusions 23 and recesses 22 define and are occupied by a sleeve or collar 26 or 33 (see FIGS. 3 and 4), each having a face 28 (see FIG. 3). The collar 26 associated with cutter 12 may be externally threaded and may be attached to or a part of shaft 13 so that an internally threaded cutter 12 may be threaded onto the shaft 13, as can be seen in FIG. 3. (Cutter 12 could be attached to shaft 13 in other ways, or need not necessarily be fixed to prevent rotation on shaft 13 except when the cutter assembly 10 is configured and assembled for use with all of its components (except the rotating portion of bearing 24) fixed in position on shaft 13). Collar or sleeve 33 associated with cutter 14 may be formed as part of cutter 14 and may have a smooth cylindrical surface as is depicted in FIG. 3. The two faces 28 of collars 26 and 23 oppose each other and contact each other when the cutter assembly 10 is configured for the thinnest work-pieces it can shape (with full contact with the work-piece edge). Interposition of one or more shim washers 16 on the shaft 25 between the faces 28 of collars 26 and 33 configures cutter assembly 10 for thicker work-pieces.

Figure 5:
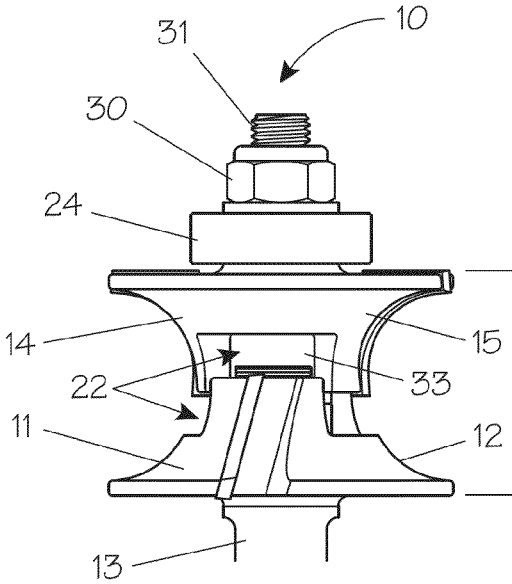
FIG. 5 is substantially the same as FIG. 2 but located on the page so that it can be directly compared to FIG. 6, which is a view like FIGS. 2 and 5, except that, in FIG. 6, washers shown positioned between the cutters in FIGS. 2 and 5 have been re-positioned (for "storage") between the bearing 24 and nut 30, so that the two cutters 12 and 14 are closer together in FIG. 6 than in FIGS. 2 and 5.
Figure 6:
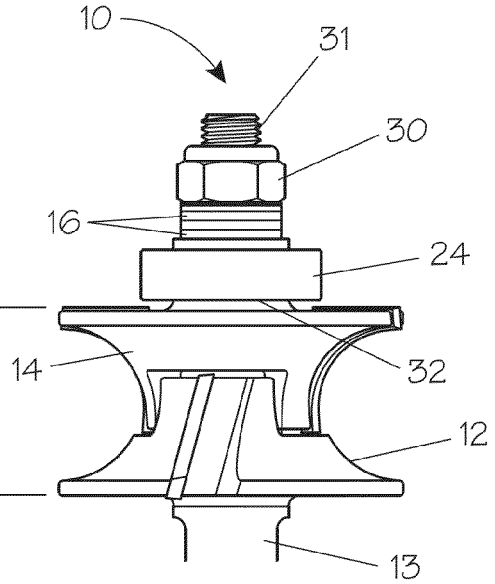

As will be appreciated by reference to FIGS. 5 and 6, this cutter component geometry permits adjustment through a significant range of thicknesses that differ by up to the full "x" distance marked between FIGS. 5 and 6. FIGS. 5 and 6 are approximately full scale drawings of one embodiment of the cutter assembly 10 of this invention that can shape the edges of work-pieces varying between about 0.75 inch and 1.0 inch, in which case the range of adjustment "x" is about 0.25 inch. Appropriate adjustments to the size (and geometry, if desired) of cutters 12 and 14 could result in other adjustment ranges such as larger ranges of approximately ⅜ inch or ½ inch or smaller adjustment ranges of approximately 3⁄32 or ⅛ inch (or the metric equivalents of all of these measurements).

A ball bearing guide or pilot 24 can be used to guide the bit 10 around the template. Such a bearing 21 is located in the assembly 10 depicted in the Figures on the side of "floating" or adjustable cutter 14 opposite the fixed cutter 12 and is sized to match the minor diameter of the cutters 12 and 14 (if it is desired that widest portion of the finished part match the template). This location places the template on top of the work-piece if the bit 10 is used in a router table. The bearing 24 could also be located adjacent to the fixed cutter 12 or could be the major diameter of the bit 10 (or have some other relationship to the cutting portions of bit 10) if the particular use so required. In order to assure free rotation, bearing 24 is separated from the face 29 of cutter 14 by a boss 32 (best seen in FIGS. 4 and 6).

Indeed, a bearing may not be required if other guide mechanisms are employed (such as, among others, guide mechanisms associated with a pin router or a CNC router). Neither does the bearing 24 need to be a roller element bearing, it could simple be a non-cutting section of one of the cutters 12 and 14 or of the shaft 26 that bears or runs against the template.

Numerous other modifications and variations of the subject matter described above are possible without departing from the scope and spirit of this invention or the following claims.

For instance, the round-over profile created by the cutters describe above and depicted below could instead be a wide variety of other profiles. As an example the cutters 12 and 14 could have radiuses of ¼ inch and essentially straight overlapping portions so that they would impart a ¼ inch radius on the corners of a work-piece with a flat intermediate edge portion.

As an example of another possible modification, while the shaft 25 depicted in the Figures is externally threaded with threads 31 and receives an internally threaded nut 30, the assembly could also be secured together using a cap screw or another screw positioned in an internally threaded hole in the threaded end of shaft 25.

Other cutters providing a variable profile will benefit from interlocking multiple cutters. As noted above, cutter assemblies can have more than two independent cutters; there could be three or more cutters in a cutter assembly of this invention, and each cutter 12 and 14 could have one blade 18 or 20, two (as depicted in the Figures), three or some other number of blades.

The invention claimed is:

1. A router cutter assembly comprising:

a. a shaft comprising:

i. a shank on one end for securing to a router in a router collet during use and ii. a threaded portion on the other end, b. a fixed cutter fixed to the shaft and comprising:

iii. two opposed protrusions that define two recesses between the protrusions and a collar and collar face surrounding the shaft, and iv. two attached carbide cutter blades one of which extends along each of the protrusions, c. a repositionable cutter for positioning on the shaft in different positions relative to the fixed cutter, the repositionable cutter comprising:

v. two opposed protrusions that define two recesses between the protrusions and a collar and collar face surrounding the shaft, and which repositionable cutter protrusions may be positioned within the fixed cutter recesses, and vi. two attached carbide cutter blades one of which extends along each of the repositionable cutter protrusions, d. a plurality of shim washers positionable on the shaft between the collar faces to position the cutters at different desired relative positions, e. a bearing positionable on the shaft on the side of the repositionable cutter opposite the fixed cutter, and f. a threaded fastener for positioning on the threaded end of the shaft for securing the components of the cutter assembly together during use.

2. The router cutter assembly of claim 1, wherein the threaded end of the shaft is externally threaded and the threaded fastener is an internally threaded nut for engagement with the externally threaded portion of the shaft.

3. The router cutter assembly of claim 1, further comprising a boss on the repositionable cutter for contact with the bearing.

* * * * *